United States Patent [19]

Rerek et al.

[11] Patent Number: 4,828,747

[45] **Date of Patent: * May 9, 1989**

[54] SUSPENDING SYSTEM FOR INSOLUBLE PEROXY ACID BLEACH

[75] Inventors: Mark E. Rerek, Fanwood, N.J.; Michael P. Aronson, West Nyack; Ralph R. Sepulveda, Suffern, both of N.Y.

[73] Assignee: Lever Brothers Company, New York, N.Y.

[ * ] Notice: The portion of the term of this patent subsequent to Apr. 25, 2006 has been disclaimed.

[21] Appl. No.: 173,329

[22] Filed: Mar. 25, 1988

[51] Int. Cl.[4] ..... C11D 3/395; C11D 7/54

[52] U.S. Cl. ..... 252/95; 252/89.1; 252/173; 252/174.21; 252/559; 252/554; 252/DIG. 4; 252/186.26; 252/186.29

[58] Field of Search ..... 252/89.1, 95, 99, 135, 252/174.23, 174.24, 174.21, DIG. 2, DIG. 11, 186.38, 186.26

[56] References Cited

U.S. PATENT DOCUMENTS

| | | | |
|---|---|---|---|
| 2,996,350 | 8/1961 | Taylor | 8/111 |
| 3,996,152 | 12/1976 | Edwards et al. | 252/186 |
| 4,017,412 | 4/1977 | Bradley | 252/186 |
| 4,126,573 | 11/1978 | Johnston | 252/99 |
| 4,443,352 | 4/1984 | Broze et al. | 252/94 |
| 4,450,089 | 5/1984 | Broze et al. | 252/95 |
| 4,455,249 | 6/1984 | Broze et al. | 252/95 |
| 4,642,198 | 2/1987 | Humphreys et al. | 252/94 |
| 4,655,781 | 4/1987 | Hsieh et al. | 8/111 |

FOREIGN PATENT DOCUMENTS

| | | |
|---|---|---|
| 176124 | 9/1985 | European Pat. Off. . |
| 240481 | 3/1987 | European Pat. Off. . |
| 254331 | 1/1988 | European Pat. Off. . |

*Primary Examiner*—Paul Lieberman
*Assistant Examiner*—John F. McNally
*Attorney, Agent, or Firm*—Milton L. Honig

[57] ABSTRACT

An aqueous liquid bleaching composition is described having a pH from 1 to 6.5 and comprising a solid, particulate, substantially water-insoluble organic peroxy acid such as diperoxydodecanedioic acid. This peroxy acid is stably suspended in an aqueous liquid by a structuring combination of anionic surfactant, ethoxylated nonionic surfactant, and fatty acid.

14 Claims, No Drawings

SUSPENDING SYSTEM FOR INSOLUBLE PEROXY ACID BLEACH

BACKGROUND OF THE INVENTION

1. Field of the Invention

The invention relates to an aqueous liquid bleaching composition comprising a solid, substantially water insoluble organic peroxy acid, which composition may be used for the treatment of fabrics and hard surfaces.

2. The Prior Art

Suspending agents for solid, substantially water insoluble organic peroxy acids in aqueous media have been reported in a number of patents.

U.S. Pat. No. 3,996,152 (Edwards et al.) discloses use of non-starch thickening agents such as Carbopol 940® to suspend bleaches such as diperazelaic acid at low pH in aqueous media. Starch thickening agents were found useful in similar systems as reported in U.S. Pat. No. 4,017,412 (Bradley). Thickening agents of the aforementioned types form gel-like systems which upon storage at elevated temperatures exhibit instability problems. When used at higher levels, these thickeners are more stable but now cause difficulties with pourability.

U.S. Pat. No. 4,642,198 (Humphreys et al.) reports a further advance in this technology by the use of surfactants as structurants. A wide variety of detergents including anionics, nonionics and mixtures thereof were reported as effective. Among the nonionics listed were alkoxylated condensation products of alcohols, of alkyl phenols, of fatty acids and of fatty acid amides. According to the examples, there is particularly preferred combinations of sodium alkylbenzene sulfonate and $C_{12}$–$C_{15}$ primary alcohols condensed with 7 moles ethylene oxide.

EP No. 0 176 124 (DeJong et al.) reports similar low pH aqueous suspensions of peroxy carboxylic acids. This art informs that surfactants other than alkylbenzene sulfonate have a detrimental effect upon chemical stability of the peroxy carboxylic acid containing suspensions. Experimental data therein shows a number of well-known detergents causing suspension destabilization. These destabilizing detergents include lauryl sulfate, $C_{15}$ alkyl ether sulfate, ethoxylated nonyl phenol, ethylene oxide/propylene oxide copolymer and secondary alkane sulfonate.

EP No. 0 240 481 (Boyer et al.) seemingly also finds some special significance in the use of alkylbenzene sulfonate and suggests that the structured diperoxy acid bleach suspensions be substantially free of other surfactants. The patent then discloses a cleaning procedure whereby a first composition of the low pH surfactant structured 1,12-diperoxydodecanedioic acid can be used in a combination with a second high pH cleaning liquid containing further surfactants, enzyme and evidently neutralized $C_{12}$–$C_{14}$ fatty acid.

U.S. Pat. No. 4,655,781 (Hsieh et al.) reports the structuring of surface active peroxy acids in substantially non-aqueous media at pH 7 to 12. Surfactants experimentally investigated included linear alkylbenzene sulfonate, fatty acids and sodium alkyl sulfate.

A problem which has been noted with all the foregoing systems is that while chemical and physical stability may have been improved within the lower temperature range, there still remain instability problems at slightly elevated temperatures.

Consequently, it is an object of the present invention to provide an improved aqueous liquid bleach composition comprising a solid, substantially water-insoluble organic peroxy acid wherein the above drawbacks are mitigated.

More specifically, it is an object of the present invention to provide an aqueous suspension of a solid, substantially water-insoluble organic peroxy acid which is chemically and physically storage stable throughout a wide range of temperatures.

These and other objects of the present invention will become apparent as further details are provided in the subsequent discussion and Examples.

SUMMARY OF THE INVENTION

An aqueous liquid bleaching composition having a pH of from 1 to 6.5 is herein provided comprising:

(i) from 1 to 40% by weight of a solid, particulate, substantially water-insoluble organic peroxy acid;

(ii) from 1 to 30% by weight of an anionic surfactant;

(iii) from 0.5 to 20% by weight of an ethoxylated nonionic surfactant; and (iv) a fatty acid present in an amount sufficient to stabilize said peroxy acid against phase separation from the aqueous liquid.

DETAILED DESCRIPTION OF THE INVENTION

It has now been discovered that water-insoluble organic peroxy acids can be stably suspended in low pH water by a combination of anionic surfactant, ethoxylated nonionic surfactant and a fatty acid. Heretofore, it had not been realized that broad temperature stability can be attained by a combination of three surfactants, especially with a system incorporating fatty acid.

Thus, the compositions of this invention will require a fatty acid, especially a $C_{12}$–$C_{18}$ alkyl monocarboxylic acid. Suitable fatty acids include lauric ($C_{12}$), myristic ($C_{14}$), palmitic ($C_{16}$), margaric ($C_{17}$), stearic ($C_{18}$) acids and mixtures thereof. Sources of four such acids may be coconut oil which is rich in the lauric constituents, tallow oil which is rich in the palmitic and stearic constituents and mixtures of coconut/tallow oils. Particularly preferred are coconut/tallow combinations of around about 80:20 ratio. Amounts of the fatty acids may range from about 0.5 to about 10%, preferably from about 1 to about 5%, optimally from about 2 to 3% by weight.

A variety of alkoxylated nonionic surfactants may be employed as the second structuring detergent. Illustrative of this category are the ethylene oxide and/or propylene oxide condensation products of $C_8$–$C_{20}$ linear- or branched-chain aliphatic carboxylic acids, aliphatic alcohols and alkyl phenols. Especially preferred, however, are the $C_{12}$–$C_{18}$ aliphatic alcohols ethoxylated with an average from about 3 to about 12 moles of ethylene oxide per alcohol molecule. Even more specifically the $C_{12}$–$C_{15}$ alcohols condensed with either an average of 3 or 9 moles ethylene oxide and the $C_{12}$–$C_{14}$ aliphatic alcohols condensed with 7 moles ethylene oxide have been found to be highly effective. Amounts of the alkoxylated nonionic will range from about 0.5 to about 20% by weight, preferably from about 1 to about 5%, optimally between about 1 and 2% by weight.

A third required structuring agent is that of an anionic surfactant. Examples of such material are water-soluble salts of alkylbenzene sulfonates, alkyl sulfates, alkyl ether sulfates, dialkyl sulfosuccinates, paraffin sulfonates, α-olefin sulfonates, α-sulfocarboxylates and their esters, alkyl glycerol ether sulfonates, fatty acid monoglyceride sulfates and sulfonates, alkyl phenol polyethoxy ether sulfates, 2-acyloxy-alkane-1-sulfonates, β-alkoxyalkane sulfonates and mixtures thereof. Although all the aforementioned anionic surfactants are operative, it has been observed that secondary alkane sulfonates exhibit an especially effective interaction with fatty acid and alkoxylated nonionic surfactant. Secondary alkane sulfonates are commercially available from Hoechst under the trademark Hostapur SAS 60. Amounts of the anionic material will range from about 1 to about 40%, preferably from about 5 to about 30%, optimally between about 5 and 10% by weight.

Organic peroxy acids usable for the present invention are those that are solid and substantially water-insoluble compounds. By "substantially water-insoluble" is meant herein a water-solubility of less than about 1% by weight at ambient temperature. In general, peroxy acids containing at least about 7 carbon atoms are sufficiently insoluble in water for use herein.

These materials have the general formula:

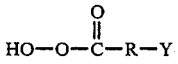

wherein R is an alkylene or substituted alkylene group containing from 6 to about 22 carbon atoms or a phenylene or substituted phenylene group, and Y is hydrogen, halogen, alkyl, aryl or

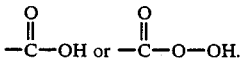

The organic peroxy acids usable in the present invention can contain either one or two peroxy groups and can be either aliphatic or aromatic. When the organic peroxy acid is aliphatic, the unsubstituted acid has the general formula:

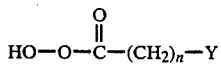

where Y can be, for example, H, $CH_3$, $CH_2Cl$, COOH, or COOOH; and n is an integer from 6 to 20.

When the organic peroxy acid is aromatic, the unsubstituted acid has the general formula:

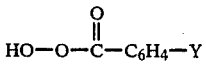

wherein Y is hydrogen, alkyl, alkylhalogen or halogen, or COOH or COOOH.

Typical monoperoxy acids useful herein include alkyl peroxy acids and aryl peroxy acids such as:

(i) peroxybenzoic acid and ring-substituted peroxybenzoic acids, e.g. peroxy-α-naphthoic acid (ii) aliphatic and substituted aliphatic monoperoxy acids, e.g. peroxylauric acid and peroxystearic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxyisophthalic acid (vi) 2-decyldiperoxybutane-1,4-dioic acid (vii) 4,4'-sulfonylbisperoxybenzoic acid.

The preferred peroxy acids are 1,12-diperoxydodecanedioic acid (DPDA) and 4,4'-sulfonylbisperoxybenzoic acid.

The particle size of the peroxy acid used in the present invention is not crucial and can be from about 1 to 2,000 microns although a small particle size is favored for laundering application.

The compositions of the invention may contain from about 1 to about 40% by weight of the peroxy acid, preferably from 2 to about 30%, optimally between about 2 and 10% by weight.

Aqueous liquid products encompassed by the invention will have a viscosity in the range of from about 50 to 20,000 centipoises (0.05 to 20 Pascal seconds) measured at a shear rate of 21 second$^{-1}$ at 25° C. In most cases, however, products will have a viscosity of from about 0.2 to about 12 PaS, preferably between about 0.5 and 1.5 PaS.

Also of importance is that the aqueous liquid bleaching compositions of this invention have an acidic pH in the range of from 1 to 6.5, preferably from 2 to 5.

Also advantageous is the use of an additional amount of hydrogen peroxide, preferably ranging from about 1 to about 10% by weight. This peroxide component has been found quite useful in preventing the staining of fabrics by metal oxides which form in the reaction between metals and organic peroxy acids.

Electrolytes may be present in the composition to provide further structuring advantage. The total level of electrolyte may vary from about 1 to about 30%, preferably from 1.5 to 25% by weight.

Since most commercial surfactants contain metal ion impurities (e.g. iron and copper) that can catalyze peroxy acid decomposition in the liquid bleaching composition of the invention, those surfactants are preferred which contain a minimal amount of these metal ion impurities. The peroxy acid instability results in fact from its limited, though finite, solubility in the suspending liquid base and it is this part of the dissolved peroxy acid which reacts with the dissolved metal ions. It has been found that certain metal ion complexing agents can remove metal ion contaminants from the composition of the invention and so retard the peroxy acid decomposition and markedly increase the lifetime of the composition.

Examples of useful metal ion complexing agents include dipicolinic acid, with or without a synergistic amount of a water-soluble phosphate salt; dipicolinic acid N-oxide; picolinic acid; ethylene diamine tetraacetic acid (EDTA) and its salts; various organic phosphonic acids or phosphonates such as hydroxyethylidenediphosphonic acid (Dequest 2010®), ethyl diamine tetra-(methylene phosphonic acid) and diethylene triamine penta-(methylene phosphonic acid).

Other metal complexing agents known in the art may also be useful, the effectiveness of which may depend strongly on the pH of the final formulation. Generally, and for most purposes, levels of metal ion complexing agents in the range of from about 10–1000 ppm are already effective to remove the metal ion contaminants.

In addition to the components discussed above, the liquid bleaching compositions of the invention may also contain certain optional ingredients in minor amounts, depending upon the purpose of use. Typical examples of optional ingredients are suds-controlling agents, fluorescers, perfumes, coloring agents, abrasives, hydrotropes and antioxidants. Any such optional ingredient may be incorporated provided that its presence in the composition does not significantly reduce the chemical and physical stability of the peroxy acid in the suspending system.

The following Examples will more fully illustrate the embodiments of this invention. All parts, percentages and proportions referred to herein and in the appended claims are by weight of the total composition unless otherwise stated.

EXAMPLE 1

A series of liquid bleach compositions were prepared by suspending 1,12-diperoxydodecanedioic acid (DPDA) in various surfactant structured liquid compositions. These formulations are outlined in Table I. Preparation of these compositions involved dissolving the appropriate amount of sodium sulfate in 10% of the water used in the formulation. Meanwhile, 35–50& of the total water was heated to 45°–50° C. When present in the formulation, fatty acid, e.g. lauric acid, was slowly added to the reactor with stirring until it had melted. Where a longer chain fatty acid was used, a higher water temperature was employed. Temperature was maintained at 45° C. and there was then added the anionic and/or nonionic surfactant. Hydroxyethylidenediphosphonic acid was added and the pH adjusted to 4. Thereafter, the sodium sulfate solution was added and the mixture stirred for about 5 minutes. DPDA was then charged to the reactor and stirred at 30°–40° C. for 30 minutes, then cooled with stirring.

TABLE I

| Ingredients | % by weight | | | | | | | |
|---|---|---|---|---|---|---|---|---|
| | A | B | C | D | E | F | G | H |
| Secondary alkane sulfonate | 9.0 | 8.0 | — | 8.0 | — | — | 8.0 | 8.0 |
| Sodium alkylbenzene sulfonate | — | — | 6.65 | — | 8.0 | 8.0 | — | — |
| $C_{12}$–$C_{15}$ primary alcohol/ 3 moles ethylene oxide | — | — | — | 2.0 | — | — | 2.0 | — |
| $C_{12}$–$C_{14}$ primary alcohol/ 7 moles ethylene oxide | — | — | — | — | — | 1.0 | — | 1.5 |
| $C_{12}$–$C_{15}$ primary alcohol/ 9 moles ethylene oxide | — | 1.0 | 2.85 | — | — | — | — | — |
| Caprylic acid | — | — | — | — | 0.14 | 0.14 | — | — |
| Capric acid | — | — | — | — | 0.12 | 0.12 | — | — |
| Lauric acid | 1.92 | 1.42 | — | — | 1.02 | 1.02 | 1.42 | 1.42 |
| Myristic acid | 0.08 | 0.56 | — | — | 0.36 | 0.36 | 0.56 | 0.56 |
| Palmitic acid | — | 0.02 | — | — | 0.20 | 0.20 | — | — |
| Stearic acid | — | — | — | — | 0.14 | 0.14 | — | — |
| Anhydrous sodium sulfate | 3.0 | 3.0 | 6.65 | 12.0 | 3.50 | 3.5 | 3.0 | 3.0 |
| DPDA | 4.9 | 5.1 | 5.21 | 4.5 | 4.83 | 4.7 | 4.85 | 5.13 |
| Dequest 2010 ® | 0.07 | 0.07 | 0.07 | 0.07 | 0.07 | 0.07 | 0.07 | 0.07 |
| Water + 10% sulfuric acid to adjust pH to 3.5–4.5 | balance | | | | | | | |

TABLE II

| Composition | Physical Stability | | |
|---|---|---|---|
| | 2° C. | 22° C. | 50° C. |
| A | unstable | stable | stable |
| B | stable | stable | stable |
| C | stable | stable | unstable |
| D | stable | stable | unstable |
| E | unstable | stable | stable |
| F | stable | stable | stable |
| G | stable | stable | stable |
| H | stable | stable | stable |

Table II provides the physical stability data for compositions outlined in Table I. Where the composition was indicated to be unstable, phase separation and settling of DPDA particles occurred within 1–5 days. Compositions were considered stable if less than 10% separation and/or phase separation occurred after one week.

Composition B incorporating sulfonate/fatty acid/nonionic ethoxylate had excellent stability both at 2° C. and 50° C. Indeed, this composition survived five freeze-thaw cycles over a two week period. By comparison, compositions C and D containing sulfonate/nonionic ethoxylate but having no fatty acid were unstable at 50° C. storage conditions. Compositions A and E containing sulfonate/fatty acid but without nonionic ethoxylate exhibited instability at 2° C. Finally, compositions F, G and H illustrate other formulations within the present invention that provides stability at low, room and elevated temperatures.

EXAMPLE 2

A typical composition of the present invention is outlined hereinbelow.

| Component | Weight % Active |
|---|---|
| 1,12-diperoxydodecanedioic acid | 4.5 |
| Hostapur 60 SAS ® | 6.0 |
| Alfonic 1412-60 ® | 2.0 |
| Emery 625 ® | 2.0 |
| Sodium sulfate | 2.8 |
| Dequest 2010 ® | 0.04 |
| Optical brightener/perfume | 0.22 |
| Deionized water | to 100% |

Emery 625 ® is a coconut oil fatty acid mixture having molecular weight ranging from 201 to 207.

The aforementioned composition was found to be stable both at 35° F. under freeze-thaw conditions and at 125° F. (50° C.) simulating elevated storage temperatures.

The foregoing description and examples illustrate selected embodiments of the present invention and in light thereof various modifications will be suggested to one skilled in the art, all of which are within the spirit and purview of this invention.

What is claimed is:

1. An aqueous liquid bleaching composition having a pH of from 1 to 6.5 comprising:

(i) from 1 to 40% by weight of a solid, particulate, substantially water-insoluble organic peroxy acid;

(ii) from 1 to 30% by weight of an anionic surfactant;

(iii) from 0.5 to 20% by weight of an ethoxylated nonionic surfactant; and (iv) a fatty acid present in an amount sufficient to stabilize said peroxy acid against phase separation from the aqueous liquid.

2. A composition according to claim 1 wherein said peroxy acid is 1,12-diperoxydodecanedioic acid.

3. A composition according to claim 1 wherein said peroxy acid is selected from the group consisting of 1,9-diperoxyazelaic acid and 4,4'-sulfonylbisperoxybenzoic acid.

4. A composition according to claim 1 wherein said anionic surfactant is a secondary alkane sulfonate.

5. A composition according to claim 1 wherein said anionic surfactant is an alkylbenzene sulfonate.

6. A composition according to claim 1 wherein said ethoxylated nonionic surfactant is a $C_{12}$-$C_{18}$ fatty alcohol condensed with from about 3 to about 9 moles ethylene oxide per fatty alcohol molecule.

7. A composition according to claim 1 wherein said peroxy acid is present in an amount between about 2 and 10% by weight.

8. A composition according to claim 1 wherein said anionic surfactant is present in an amount between about 5 and 10% by weight.

9. A composition according to claim 1 wherein the alkoxylated nonionic surfactant is present in an amount between about 1 and 2% by weight.

10. A composition according to claim 1 wherein the fatty acid is a $C_{12}$-$C_{18}$ fatty alkyl monocarboxylic acid.

11. A composition according to claim 1 wherein the fatty acid is present in an amount from about 1 to about 5% by weight.

12. A composition according to claim 1 wherein the fatty acid is present in an amount from about 2 to 3% by weight.

13. A composition according to claim 1 having a viscosity from 0.05 to 20 PaS measured at a shear rate of 21 $sec^{-1}$ at 25° C.

14. A composition according to claim 1 further comprising from about 1 to about 10% additional hydrogen peroxide.

* * * * *